US008529148B2

(12) United States Patent
Hoek et al.

(10) Patent No.: US 8,529,148 B2
(45) Date of Patent: Sep. 10, 2013

(54) PAINTING DEVICE

(75) Inventors: Amerik Hoek, Katwijk Aan Den Rijn (NL); Lennox J. Alblas, Badhoevedorp (NL); Bernard J. Den Ouden, Nieuw Vennep (NL)

(73) Assignee: Akzo Nobel Coatings International B.V., Arnhem (NL)

( * ) Notice: Subject to any disclaimer, the term of this patent is extended or adjusted under 35 U.S.C. 154(b) by 401 days.

(21) Appl. No.: 12/812,374

(22) PCT Filed: Jan. 6, 2009

(86) PCT No.: PCT/EP2009/050061
§ 371 (c)(1),
(2), (4) Date: Oct. 4, 2010

(87) PCT Pub. No.: WO2009/087140
PCT Pub. Date: Jul. 16, 2009

(65) Prior Publication Data

US 2011/0017138 A1 Jan. 27, 2011

(30) Foreign Application Priority Data

Jan. 9, 2008 (EP) ..... 08100271

(51) Int. Cl.
*B43K 29/00* (2006.01)

(52) U.S. Cl.
USPC ..... 401/193; 401/21; 401/143

(58) Field of Classification Search
USPC ..... 401/48, 193; 15/159.1, 179; 118/715, 118/323
See application file for complete search history.

(56) References Cited

U.S. PATENT DOCUMENTS

| | | | | | |
|---|---|---|---|---|---|
| 1,886,863 | A | * | 11/1932 | Barden | 33/42 |
| 1,960,725 | A | | 5/1934 | Bramsen et al. | |
| 2,660,791 | A | * | 12/1953 | Howell et al. | 33/41.6 |
| 2,712,667 | A | * | 7/1955 | Stearn et al. | 15/246 |
| 2,837,757 | A | * | 6/1958 | Katanich | 15/246 |
| 2,936,474 | A | * | 5/1960 | Custer | 15/230.11 |
| 3,109,755 | A | * | 11/1963 | Stanley | 118/258 |
| 3,448,722 | A | * | 6/1969 | Krizman | 118/207 |
| 3,981,595 | A | * | 9/1976 | Blake | 401/48 |

(Continued)

FOREIGN PATENT DOCUMENTS

| | | |
|---|---|---|
| CN | 1931444 | 3/2007 |
| FR | 860 268 | 1/1941 |

(Continued)

OTHER PUBLICATIONS

International Search Report and Written Opinion, PCT International Patent Application No. PCT/EP2009/050061, dated Apr. 17, 2009.

(Continued)

*Primary Examiner* — David Walczak
*Assistant Examiner* — Jennifer C Chiang
(74) *Attorney, Agent, or Firm* — Kenyon & Kenyon LLP

(57) ABSTRACT

A device for applying paint includes a paint applicator and a guiding means, the guiding means consists of two guiding rollers, the axis of rotation of each roller being fixed in use such that the two axes are disposed at an angle to one another in the range from 50° to 130° . The device is particularly suitable for applying paint in a linear strip of predetermined width along architectural objects such as window sills and sashes, lintels and beams.

15 Claims, 6 Drawing Sheets

(56) References Cited

U.S. PATENT DOCUMENTS

| | | | | |
|---|---|---|---|---|
| 4,260,273 | A * | 4/1981 | Hemperly et al. | 401/48 |
| 4,296,317 | A * | 10/1981 | Kraus | 250/215 |
| 4,337,723 | A | 7/1982 | Davis | |
| 4,383,496 | A | 5/1983 | Shotwell | |
| 5,309,643 | A * | 5/1994 | McCollom | 33/32.2 |
| 5,386,610 | A * | 2/1995 | Batanjski | 15/230.11 |
| 5,544,384 | A * | 8/1996 | Forselius et al. | 15/235.7 |
| 5,774,924 | A * | 7/1998 | Beckham et al. | 15/235.7 |
| 6,250,830 | B1 * | 6/2001 | Clark | 401/48 |
| 6,450,232 | B1 * | 9/2002 | Smythe, Jr. | 156/579 |
| 6,593,298 | B2 * | 7/2003 | Jackowski et al. | 435/7.1 |
| 6,866,716 | B1 * | 3/2005 | Montemurro | 118/211 |
| 7,017,838 | B2 | 3/2006 | Schmon | |

FOREIGN PATENT DOCUMENTS

| | | |
|---|---|---|
| GB | 2 089 688 | 6/1982 |
| GB | 2 098 688 | 11/1982 |
| JP | 60-241962 | 11/1985 |
| JP | 2001-025701 | 1/2001 |

OTHER PUBLICATIONS

Reply to Written Opinion, PCT International Patent Application No. PCT/EP2009/050061, dated Sep. 7, 2009.

International Preliminary Report on Patentability, PCT International Patent Application No. PCT/EP2009/050061, dated Jan. 13, 2010.

* cited by examiner

Fig. 2a
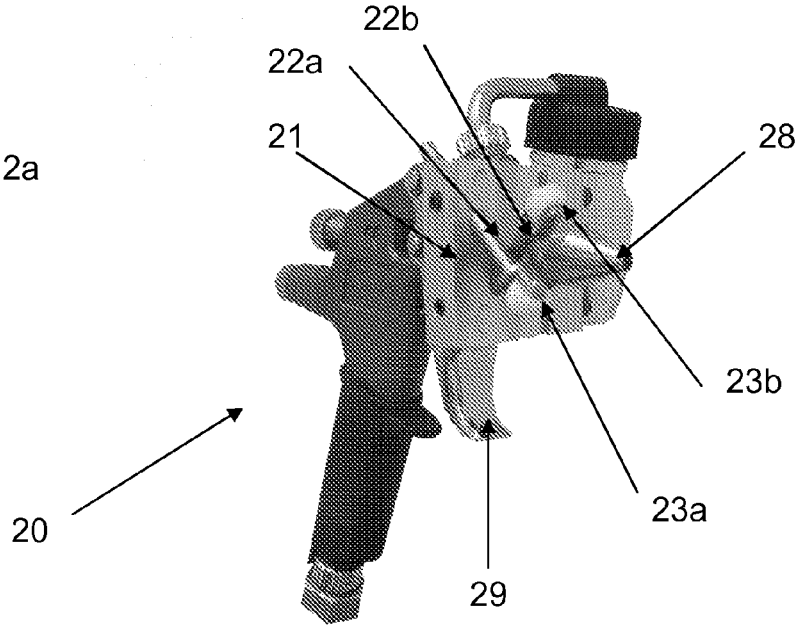
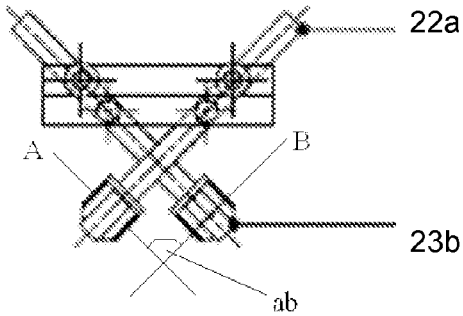
Fig. 2b
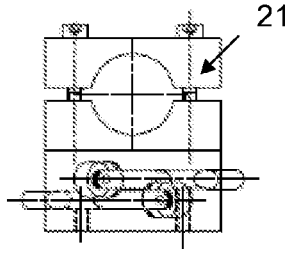
Fig. 2c
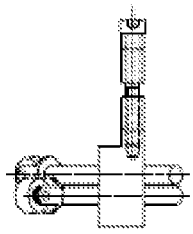
Fig. 2d

PAINTING DEVICE

FIELD OF THE INVENTION

This invention relates to a device for applying a thin strip of a coating composition to a surface. More particularly this invention relates to a portable, hand-held device for applying a strip of a coating composition of predetermined width to a surface and which minimizes or prevents that composition from contacting or smearing unwanted portions of the surface.

BACKGROUND OF THE INVENTION

When applying a coating composition (e.g. paint) to particular structures such as window and picture frames, door panels and lintels, it is often desirable to prevent the coating from contacting areas adjacent to the structure. Painters will often outline the structure with masking tape or another protective coating so that minor inaccuracies in their brush strokes or spraying are prevented from reaching the underlying surface. This outlining process is obviously time-consuming. Furthermore, the removal of the protective tape or coating can leave behind remnants of adhesive on the surface.

As a consequence of these problems, a plethora of paint guides and masking devices have been developed. Such devices are described in UK Patent No. 2,098,688, Japanese Laid-Open Publication No. JP-60-241962 and U.S. Pat. Nos. 4,296,317 and 4,383,496.

U.S. Pat. No. 4,383,496 (Shotwell) discloses a device for painting a window frame together with a tiny perimeter of glass adjacent to the frame. The painted glass perimeter acts to supplement the weatherproofing of the window. The device comprises a frame having a central body portion which is connected at its distal ends via two brackets to a pair of supporting arms, each arm comprising a forward end, a vertical wall and a bottom flange into which are impressed two feet. The central body portion has a flat top from which extend front and rear flanges. The front flange is further extended through the attachment a spring-biased shield which is configured to terminate in a straight edge which extends longitudinally throughout the length of the shield.

In use, the device of U.S. Pat. No. 4,383,496 is placed on a glass surface that is terminated by a frame edge such that the forward end of the arms abuts that frame edge. A small downward pressure applied to the device overcomes the spring-bias of the shield and moves its straight edge into contact with the glass surface. This exposes a thin strip of window glass that is constrained between the frame edge, the two distal arms of the device and the sealing edge. While this pressure is being applied, that portion of the window frame adjacent the device may be painted along with the thin strip. When this pressure is removed, the edge no longer acts as a seal onto the glass. However, at this point the device may be slid along the frame edge using the feet of the arms. A new, discrete section of the frame and a new, discrete strip of window glass may then be painted by repeating the application of pressure.

As a consequence of its configuration, the device of U.S. Pat. No. 4,383,496 does not enable the continuous delivery of paint to the frame or glass perimeter. It is furthermore reliant on the surface being painted having a frame edge of a certain height and integrity.

UK Patent No. 2,089,688 (Daniel) discloses a paint applicator in the form of a spray gun to which is attached a guide. As shown in the FIGS. 1 and 2 of this document, the guide comprises two parallel side edges which extend forward from their point of attachment at the spray gun to two leading edges. In use, the spraying tip of the gun is adjusted such that the spray is released within the bounds of the two parallel, extending side edges. The leading edges are brought into the position wherein they abut a protruding feature, such as a trim edge, along which the paint is to be applied. The applicator must then be moved carefully to maintain the contact between the leading edges and the protrusion.

U.S. Pat. No. 4,296,317 (Kraus) discloses a paint application machine comprising a spray gun controlled by light intensity and electrical pulses, a spray gun guide device and a spray control unit operating in dependence on the position of the spray gun guide device. The guide device essentially consists of two parts. The first part comprises a telescopic arm at the end of which the spray gun is mounted. The telescopic arm is generally held horizontally and, when the machine is moved along a defined line, it is prevented from vibrational shifting off that line. The second part of the guide device comprises a spacing wheel located on the gun housing just underneath the paint exit opening. The wheel ensures the spray gun is maintained at a uniform distance from the working surface.

Japanese Laid-Open Publication No. JP-60-241962 describes a device for applying a coated film of uniform width on or adjacent to, in particular, a window. Paint, provided in a vessel is forced through a pipe into a brushing means that comprises an outlet tip. This brushing means is provided with a bracket which appears to act as a guiding means.

STATEMENT OF THE INVENTION

In accordance with the invention there is provided a portable, hand-held device for applying a coating composition, said device comprising an applicator and a guiding means and being characterized in that said guiding means consists of two guiding rollers, the axis of rotation of each roller being fixed in use such that the two axes are disposed at an angle to one another in the range from 50° to 130°.

The term "fixed in use" is here intended to mean that the angle between the axes of rotation of the guiding rollers (or wheels) is either permanently set within the stated range or is adjustable but can be temporarily set within the stated range prior to the employment of the device.

The device is primarily intended to be used by an individual to apply those compositions which are typically applied to an architectural surface including but not limited to paints, inks, protective coatings and varnishes. It is particularly suited to the application of coating compositions as linear strips of predetermined width, along structures such as window sills, window sashes, structural beams and lintels.

These coating compositions are dispensed through the applicator to contact a given locus on a substrate. The device may then be moved by engaging the guiding means with the substrate and rolling the device in a desired direction. The angular disposition of the wheels or rollers is essential to fixing the movement of the spraying device in a straight line. Additionally, for the painting of cornered objects such a sills or window frames, the angular disposition of the wheels or rollers allows them to keep in contact with both the about vertical and horizontal part of the corner.

The exact form of the paint applicator is not particularly limited and may comprise a brush, an airbrush, a spray gun, a roller, a pen, a marker pen or an aspergillum. The width of the strip provided by the device is predominantly determined by the particular choice of applicator. For example, a brush will provide a strip having a width matching the contact width of the brush to the surface. Air brushes and spray guns may apply both narrow and broad strips by controlling the pressure of the composition feed and the structure of the nozzle through which the composition is ejected.

In a preferred embodiment of the invention the guiding means comprises guiding arms at the end of which the guiding rollers are disposed. The rollers may be held in a fixed position at the end of the guiding arms, but it may be useful to allow the individual rollers to be rotatable between two mutually perpendicular positions.

Each guiding arm will be disposed at an angle to one another when either connected directly to the applicator or connected to a mount attached to the applicator. An angle of 90° between the respective arms has been found to be particularly suitable for controlling the movement of this device but the angle may equally be less than or equal to (≦) 90° and/or adjustable.

Where they are present in the device of this invention, each guiding arm may be of a fixed length but can equally be extendible to control the distance (d) of the applicator from the surface to be coated. For those applicators which eject a diffuse or radiating spray of coating composition, this distance (d) determines the area of substrate coated at a particular locus and the dimensions of the strip then produced by the motion the device.

Although not required for this invention, the contact of the device with surface to be painted may be further stabilized by removably or permanently attaching a slide to the paint applicator. Such a slide may give additional control of the movement of the device and can prevent any overspray from the applicator contacting the surface.

BRIEF DESCRIPTION OF THE DRAWINGS

The invention will be illustrated by reference to the appended drawings in which:

FIG. 2*a* depicts a device according to one embodiment of the present invention wherein one possible configuration of the guiding means has been attached to the applicator shown in FIG. 1;

FIGS. 2*b* to 2*d* different perspective views of that configuration of the guiding means included in the device shown in FIG. 2*a;*

DETAILED DESCRIPTION OF THE INVENTION

Figure 1:
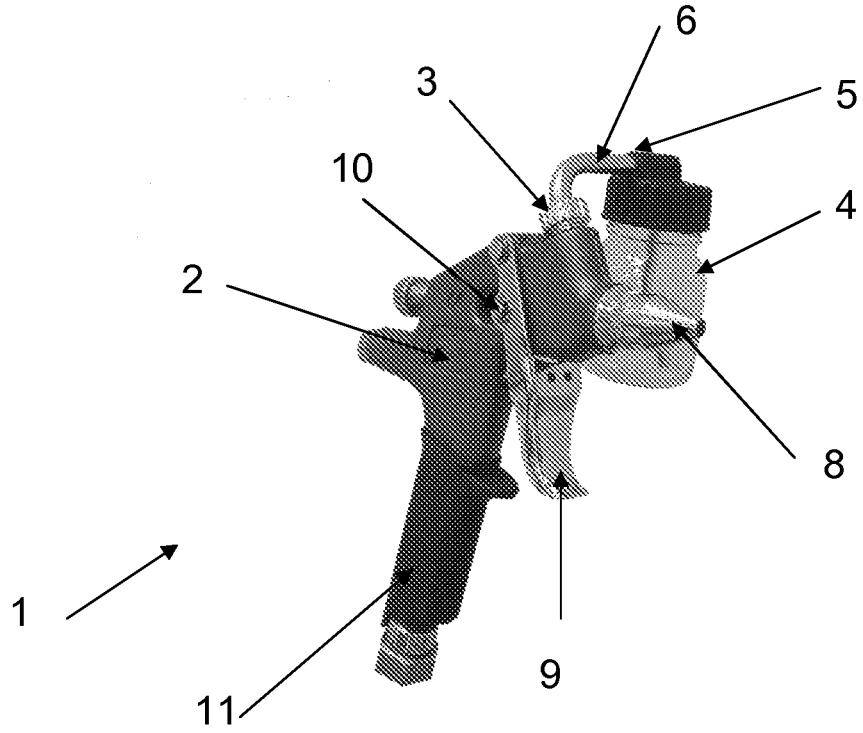
FIG. 1 depicts an applicator suitable for inclusion in the device of this invention.

FIG. 1 illustrates a paint applicator suitable for inclusion in the device of this invention and to which the guiding means described hereinafter will be attached. This paint applicator or spraying gun (1) has a gun body (2) which includes a connecting region (3). This connecting region comprises a receiving bore (not shown) for removably attaching a paint receptacle, and a moveable cover (not shown) positioned at the lower end of said receiving bore. Herein the paint receptacle is depicted as comprising a gravity-feed container (4) which can be rotated about point (5) to initiate or stop flow of paint along the passage (6).

The cover is provided with a plastic or metal drip stop which serves to close the gravity feed container (4) when received in the receiving bore. Said cover is removably secured to the distal end of the passage (6) of the gravity feed container (4) with the aid of a thread or the like, said thread being connected to a trigger mechanism (9) which is pivotable about axis (10). The gun body is also provided with a nozzle (8) that is in operative connection with the connecting region (3).

In use, the paint spraying gun (1) will be held by the painter using handle (11). Although the handle (11) here is shown to have a cuboid shape, the handle may equally have a wedge-, sector-, pisciform- or fan-shape as is known in the art. In any event, the handle (11) is preferably adapted to allow at least a substantial portion of the handle to be supported by the junction of the thumb and forefinger of the user's hand. Equally, it is preferred that the handle is symmetrical about its median plane such that it may be held in both a left and a right hand with equal effectiveness and comfort.

The paint receptacle (4) is rotated into an upright position causing paint therein to flow under gravity along passage (6). A depth of said paint builds up against the plastic or metal drip stop which thereby generates a downward pressure on said drip stop.

The depression of the trigger mechanism (9) in the direction shown moves the drip stop away from the distal end of the passageway (6). Paint flows under gravity from this point to the nozzle (8). That nozzle body (8) is provided with an inlet, at least one passageway and at least one orifice through which the paint is dispensed.

Although nozzles having a fixed structure may be employed in this invention—for example a nozzle provided with a fixed number and/or fixed orifice size—it is preferable that the nozzle is adapted to provide a means to control the flow of the dispensed composition. Typical adaptations include providing the nozzle with: means to adjust the diameter of the nozzle passageway(s); means to adjust the shape and dimensions of the orifice(s); needle valves; moveable deflection means; and, the like. Equally, where the nozzle is provided with a plurality of orifices having a particular distribution, the nozzle may be provided with means for opening and closing particular orifices of that distribution; such a means is disclosed for example in CN1931444. The adaptations control the diffusivity of the paint or coating composition ejected from the nozzle and therefore the area of a surface contacted by the paint at a given point.

The skilled reader will recognize that a number of adaptations could be made to this applicator without departing from the scope of this invention. In the applicator of FIG. 1 which dispenses paint under a gravimetric flow, the nozzle (8) may easily be replaced with a roller, a brush, a marker tip, a pen tip or an aspergillum that is adapted to receive a feed of paint from the container (4). Equally, where a pen tip, marker tip or aspergillum is employed it may not be suitable to provide the paint as a flow along a hollow passage (6) from the paint container (4): the paint may be provided by capillary action through an absorbent material, for example.

For faster rates of paint dispensing, the gravimetric feed to the nozzle (8) shown in FIG. 1—or to the brushes and the like disclosed above—may be replaced with a pressurized feed. Such a device spray gun should preferably be equipped with a pressure-regulating valve to control atomization or delivery of the coating composition. Furthermore, the pressure available to the device should preferably be monitored using an integral manometer to recognize possible pressure drops due to additional loads on the compressed-air network or pressure increases due to the activation of resources.

The manometer and the pressure regulating valve may be connected directly to the input of the spray gun. Alternatively, the manometer may be connected to the input of the spray via a capillary tube or other pressure coupling means. Such coupling means may be provided within or outside of the main spray gun housing and the manometer itself may be disposed outside the spray gun or provided as an integral part of the housing. Suitable arrangements of manometers and pressure-regulating valves for use in the present invention are discussed inter alia in U.S. Pat. No. 7,017,838 (Ewald).

FIG. 2*a* illustrates the paint applicator (20) of FIG. 1 to which a guiding means has been attached in accordance with an embodiment of the present invention. The applicator (20) is provided with a mount (21) positioned close to the nozzle (28) of the applicator (20) in order not to interfere with the depression and release of the trigger mechanism (29). The mount (21) supports two arms (22*a*, 22*b*) at the end of each of which is disposed a wheel or roller (23*a*, 23*b*).

FIGS. 2*b*, 2*c* and 2*d* provide further views of the mount (21), arms (22*a*, 22*b*) and rollers (23*a*, 23*b*) in which the remainder of the paint applicator has been omitted. In FIG. 2*b*, the axis of rotation (A) of the first roller or wheel (23*a*) is depicted at an angle (ab) to the axis of the rotation (B) of the second roller or wheel (23*b*). The angle (ab) is fixed in the use of this device (20).

Figure 3:
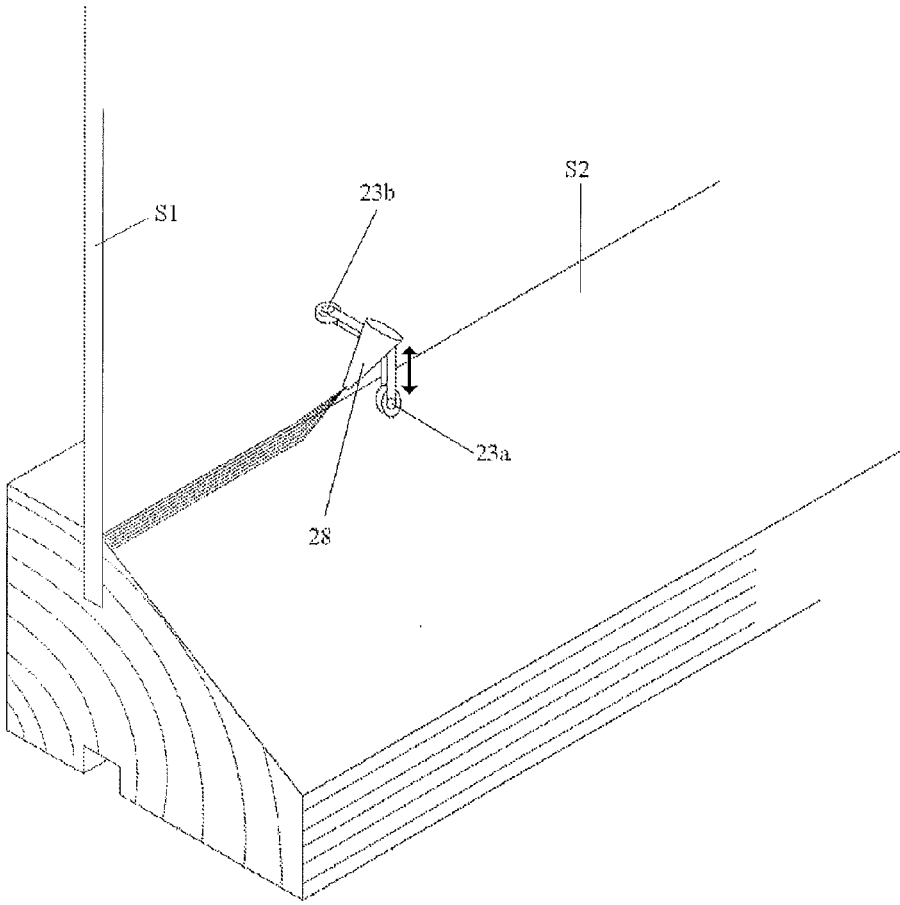
FIG. 3 is an illustration of how the device depicted in FIG. 2*a* may be used.

As shown in FIG. 3. the wheels (23*a*, 23*b*) disposed at the end of the guiding arms may keep in contact with each of two angularly disposed surfaces (SI, S2), such as the vertical and horizontal part of a cornered object for example. This will enable the spray device to be rolled easily in a straight line along a corner-like sill or window frame that is to be painted. By maintaining contact between the object and the wheels (23*a*, 23*b*) of the device, the width of the coating applied can be accurately controlled, being determined in this circumstance by parameters, such as nozzle pressure and aperture size, which can be set or pre-set by the user. At least one of the arms may be extendible.

The angle (ab) between the axes of rotation of the rollers (23*a*, 23*b*) is preferably adjustable in the range 50° to 130° to allow the device to be used in the shown in FIG. 3 for two surfaces disposed at a range of angles. To reflect the more common architectural scenario that the two surfaces (S1, S2) will be approximately perpendicular, it is preferred that the angle (ab) may be fixed in use between 75° and 105°, preferably between 80° and 100° and more preferably between 85° and 95°.

Figure 4A:
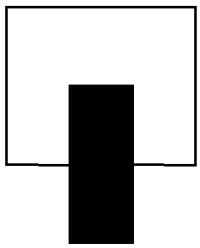
FIGS. 4*a* to 4*d* depict different forms and modes of attachment for the rollers which may be included in the guiding means of the device according to this invention.
Figure 4B:
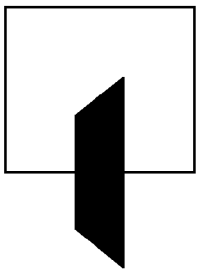
Figure 4C:
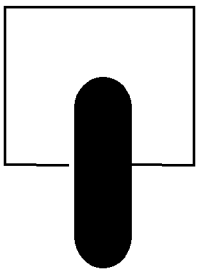

FIGS. 4*a*-4*c* illustrate different forms of rollers which may be included in the devices of this invention. FIG. 4*a* illustrates a cylindrical or "flat" roller; FIG. 4*b* shows a conical roller in which the wheel or roller is provided with a degree of tapering; and. FIG. 4*c* shows a rounded form. Other shapes of roller or wheel are possible including, for example, grooved wheels. However, it is preferable that the rotation of the wheel or roller in contact with the surface to be painted does not mar or scratch that surface.

Figure 4D:
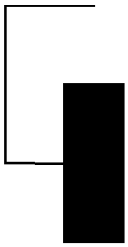

Although the wheels or rollers are depicted in FIGS. 4*a* to 4*c* as being connected to (arms of) the device on two sides, they may similarly be connected on a single side. This embodiment is illustrated in FIG. 4*d*. In either configuration, a resilient connection is required to limit or prevent wobbling or vibration of the roller or wheel about its axis.

The material from which the wheels or rollers are made should allow them to roll freely over the surface. The material should therefore not have residual tackiness or abrasiveness.

In FIGS. 2*a* to 2*d*, the wheels and rollers (23*a*, 23*b*) are depicted as each being disposed at the end of a straight arm (22*a*, 22*b*). Those arms are not strictly required in the device of this invention; the wheels or rollers may equally be disposed within the mount (21) or attached directly to the body of the device. However, it is preferable that the device comprises arms. Those arms may also be connected either to the mount (21) or directly to the device's body.

Figure 5A:
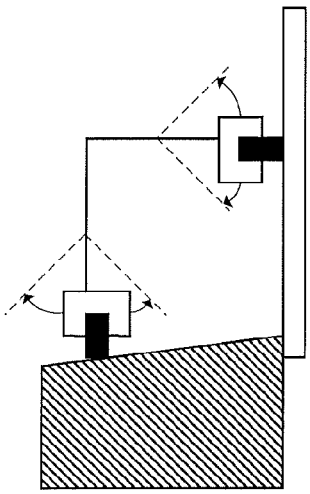
FIGS. 5*a* to 5*f* concern that embodiment of the invention wherein the guiding means comprises guiding arms and depict different configurations of said guiding arms.
Figure 5B:
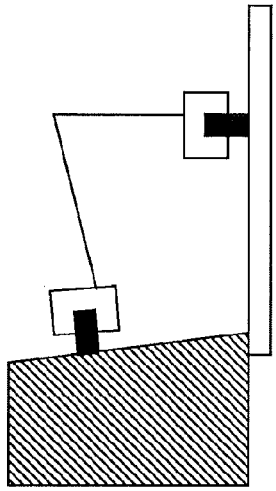
Figure 5C:
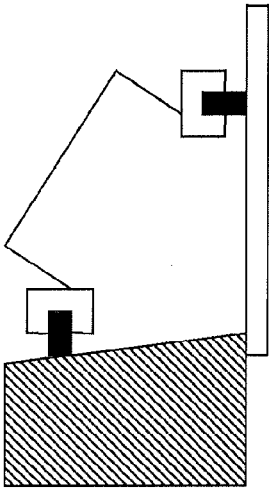
Figure 5D:
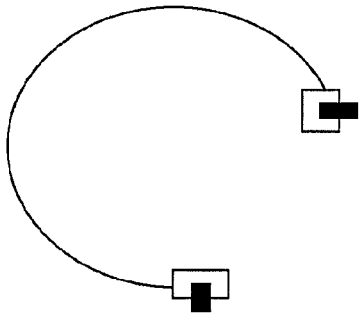
Figure 5E:
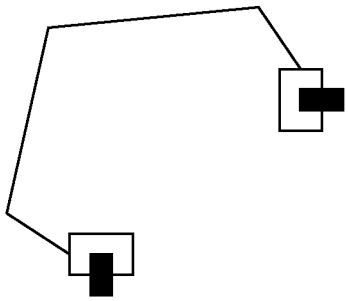
Figure 5F:
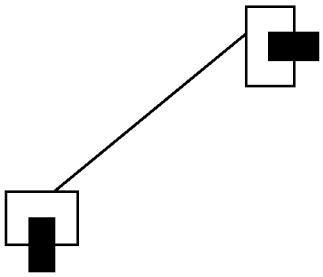

A number of different configurations of such arms can be used to provide two rollers or wheels having angularly disposed axes of rotation. A few such configurations are illustrated in FIGS. 5*a* to 5*g* wherein the body of the device has been omitted for clarity and the two wheels or rollers have perpendicular axes of rotation. In FIG. 5*a* the arms are perpendicular to one another; in FIG. 5*b* those arms are provided at an angle slightly less than 90° but wherein the wheels or rollers are still disposed in an identical position to those of FIG. 5*a*. Similarly, the perpendicular roller positions are maintained for each of the arm arrangements of FIGS. 5*c* to 5*f*. However, as schematically depicted in FIG. 5*a*, it may be useful to allow the individual rollers to be rotatable between two mutually perpendicular positions.

The material from which the arms of the device are manufactured is limited only in that it must remain rigid under the pressure applied for application of the paint. For example, the force applied by the user when moving the device along a sash cannot cause those arms to bend. Typically the arms are constructed from metals or metal alloys and in particular those metals and alloys which can be cast or molded.

It is envisaged that a least a part of the device may be provided with either a coating or with an impregnated compound that limits the sticking of paint to that part. Examples of non-stick resins suitable for use in this way include polytetrafluoroethylene (PTFE), fluorinated ethylenepropylene (FEP), polyvinylidene fluoride (PVDF), perfluoroalkoxy (PFA), and ethylene chlorotrifluoroethylene (ECTFE) many of which are available commercially under the Teflon® trademark. Non-stick coatings may be applied to a part of the device as required via spraying or dipping, optionally followed by baking, as is known to those of ordinary skill in the art.

The invention claimed is:

1. A portable, hand-held device for applying a coating composition, said device comprising an applicator and a guiding means, wherein said guiding means comprises two guiding rollers, the axis of rotation of each roller being fixed in use such that the two axes are disposed at an angle to one another in the range from 50° to 130° and wherein the guiding means includes guiding arms connected directly or connected to a mount attached to the applicator, wherein the guiding arms are disposed at an angle, and wherein the guiding rollers are disposed at the distal end of said arms.

2. The device according to claim 1, wherein the applicator comprises a brush.

3. The device according to claim 1, wherein the applicator comprises an airbrush.

4. The device according to claim 1, wherein the applicator comprises an element selected from the group consisting of: a nozzle, a roller, a pen, a marker pen, and an aspergillum.

5. The device according to claim 1, wherein the guiding means includes a guiding arm, said guiding rollers being disposed at opposite ends of said arm.

6. The device according to claim 1, wherein the guiding means includes two guiding arms at the ends of each of which the guiding rollers are disposed.

7. The device according to claim 1, wherein the two arms are disposed at an angle of 90° to each other.

8. The device according to claim 1, wherein the two arms are disposed at an angle of ≦90° to each other, which angle is adjustable.

9. The device according to claim 6, wherein said arms are of a fixed length.

10. The device according to claim 6, wherein at least one of said arms is extendible.

11. The device according to claim 6, wherein each guiding roller is rotatable between two mutually perpendicular positions.

12. The device according to claim 4, wherein the two arms are disposed at an angle of ≦90° to each other.

13. The device according to claim 8, wherein said arms are of a fixed length.

14. The device according to claim 8, wherein at least one of said arms is extendible.

15. The device according to claim 1, wherein the applicator is a spray gun.

* * * * *

UNITED STATES PATENT AND TRADEMARK OFFICE

CERTIFICATE OF CORRECTION

PATENT NO. : 8,529,148 B2
APPLICATION NO. : 12/812374
DATED : September 10, 2013
INVENTOR(S) : Hoek et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this
Fifteenth Day of September, 2015

Michelle K. Lee

Michelle K. Lee
*Director of the United States Patent and Trademark Office*